US005177982A

United States Patent [19]

Plemens

[11] Patent Number: 5,177,982

[45] Date of Patent: Jan. 12, 1993

[54] ACCUMULATOR DESICCANT BAG RETAINING CLIP

[75] Inventor: Mark T. Plemens, Brookville, Ind.

[73] Assignee: Ford Motor Company, Dearborn, Mich.

[21] Appl. No.: 812,446

[22] Filed: Dec. 23, 1991

[51] Int. Cl.[5] ..... F25B 43/00

[52] U.S. Cl. ..... 62/503; 55/387; 210/282; 210/DIG. 6

[58] Field of Search ..... 62/474, 475, 503; 55/387; 210/282, DIG. 6

[56] References Cited

U.S. PATENT DOCUMENTS

| | | | |
|---|---|---|---|
| 4,116,649 | 9/1978 | Cullen et al. | 55/387 |
| 4,401,447 | 8/1983 | Huber | 55/387 |
| 4,405,347 | 9/1983 | Cullen et al. | 62/503 |
| 4,457,843 | 7/1984 | Cullen et al. | 55/387 |
| 4,464,261 | 8/1984 | Cullen et al. | 55/387 |
| 4,474,035 | 10/1984 | Amin et al. | 62/503 |
| 4,619,673 | 10/1986 | Cullen et al. | 55/387 |
| 4,911,739 | 3/1990 | Cullen et al. | 55/387 |
| 4,994,185 | 2/1991 | Cullen et al. | 55/387 |
| 5,022,902 | 6/1991 | Juhl et al. | 55/387 |

*Primary Examiner*—Ronald C. Capossela
*Attorney, Agent, or Firm*—Raymond L. Coppiellie; Roger L. May; Clifford L. Sadler

[57] ABSTRACT

There is a disclosed herein a retaining clip for a desiccant bag used in an accumulator of an air conditioning system for an automotive vehicle. The retaining clip is hinged at one end and surrounds the bag of desiccant. The clip includes integrally formed tube engaging mechanisms for matingly engaging the refrigerant tubes within the housing of the accumulator.

19 Claims, 2 Drawing Sheets

ACCUMULATOR DESICCANT BAG RETAINING CLIP

BACKGROUND OF THE INVENTION

1. Field of the Invention

The present invention relates generally to accumulators for automotive air conditioning systems. More particularly, the present invention relates to a retaining clip for securing a desiccant bag in such an accumulator.

2. Disclosure Information

It is known to place an adsorbent device such as a flexible bag of desiccant, in an accumulator of an automotive air conditioning system to adsorb undesirable substances from the refrigerant. Numerous ways of securing the adsorbent device in position have been proposed, such as by flaps, harnesses, and wires. Typically, the flaps or harnesses are attached to the refrigerant pipes by threading the pipe through an aperture in a flap attached to a casing of the adsorbent device such as is shown in U.S. Pat. No. 4,116,649. It has also been known to mechanically wire the adsorbent device between the refrigerant pipes. In such a configuration, it is necessary to first surround the adsorbent device with a piece of heat resistant material to protect the device during fabrication of the accumulator. One such mechanism is shown in U.S. Pat. No. 4,474,035, assigned to the assignee of the present invention, the disclosure of which is hereby incorporated by reference.

SUMMARY OF THE INVENTION

It is an object of the invention to provide a retaining clip for a desiccant bag which maintains the bag in the proper location and which protects the bag from excessive heat given off during welding.

It is a feature of the present invention to retain a desiccant bag of an accumulator in position between the refrigerant pipes and to protect it from the heat generated during the fabrication process without the use of a tie wire assembly and a heat resistant foil around the bag.

It is an advantage of the present invention that the desiccant bag can be snapped into its proper position between the refrigerant pipes of the accumulator with very little labor.

In one principal aspect of the present invention, there is provided an accumulator for use in an automotive air conditioning system for an automotive vehicle comprising a housing having two portions joined together in abutting relationship at a predefined seam location to define a closed chamber, the housing having an upper housing wall and a lower housing wall. The accumulator further includes an inlet tube extending through the upper wall of the housing and an outlet tube extending through the upper wall of the housing and extending through the housing substantially the entire length thereof. The outlet tube includes first and second pipe portions connected by a curved portion disposed at a lower extremity of the housing, the second pipe portion extending upwardly through the housing to a point proximate the upper wall of the housing. The accumulator also includes retaining means surrounding an adsorbent device for securing the device between the first and second pipe portions of the outlet tube. The retaining means comprises a jaw-like member including a first sidewall and a second sidewall, each of the first and second sidewalls comprising a generally arcuate member having a generally planar base portion and a pair of walls extending generally perpendicularly therefrom. The first and second sidewalls are hingedly connected at one end thereof for relative movement therebetween and connectable to one another at an opposite end thereof. Each one of the pair of sidewalls also includes tube engaging means formed integrally therewith for mating engagement with the first and second pipe portions of the outlet tube.

There is also disclosed herein an apparatus for retaining an adsorbent device such as a flexible bag of desiccant, between a pair of tubular members in an accumulator of an automotive air conditioning system. The apparatus comprises a pair of generally planar, opposite facing sidewalls, each sidewall having a tube engaging means formed integrally therewith for mating engagement with tubular members. The apparatus further includes a third side interconnecting one end of the pair of sidewalls and including hinge means for relative open and close movement of the pair of sidewalls as well as a fourth side interconnecting an opposite end of the pair of sidewalls and including locking means for securing the retaining means around the adsorbent device. In one embodiment of the invention, the tube engaging means comprises an arcuate-shaped groove molded in each pair of sidewalls, the diameter of the groove being slightly smaller than the diameter of the tubular members for mating engagement therewith. The locking means may comprise a tab formed on the fourth side, the tab having a plurality of indentations adapted to matingly engage a plurality of ribs formed proximate thereto.

These and other objects, features and advantages of the present invention will become apparent from the following detailed description and claims which follows.

DETAILED DESCRIPTION OF THE PREFERRED EMBODIMENT

Figure 1:
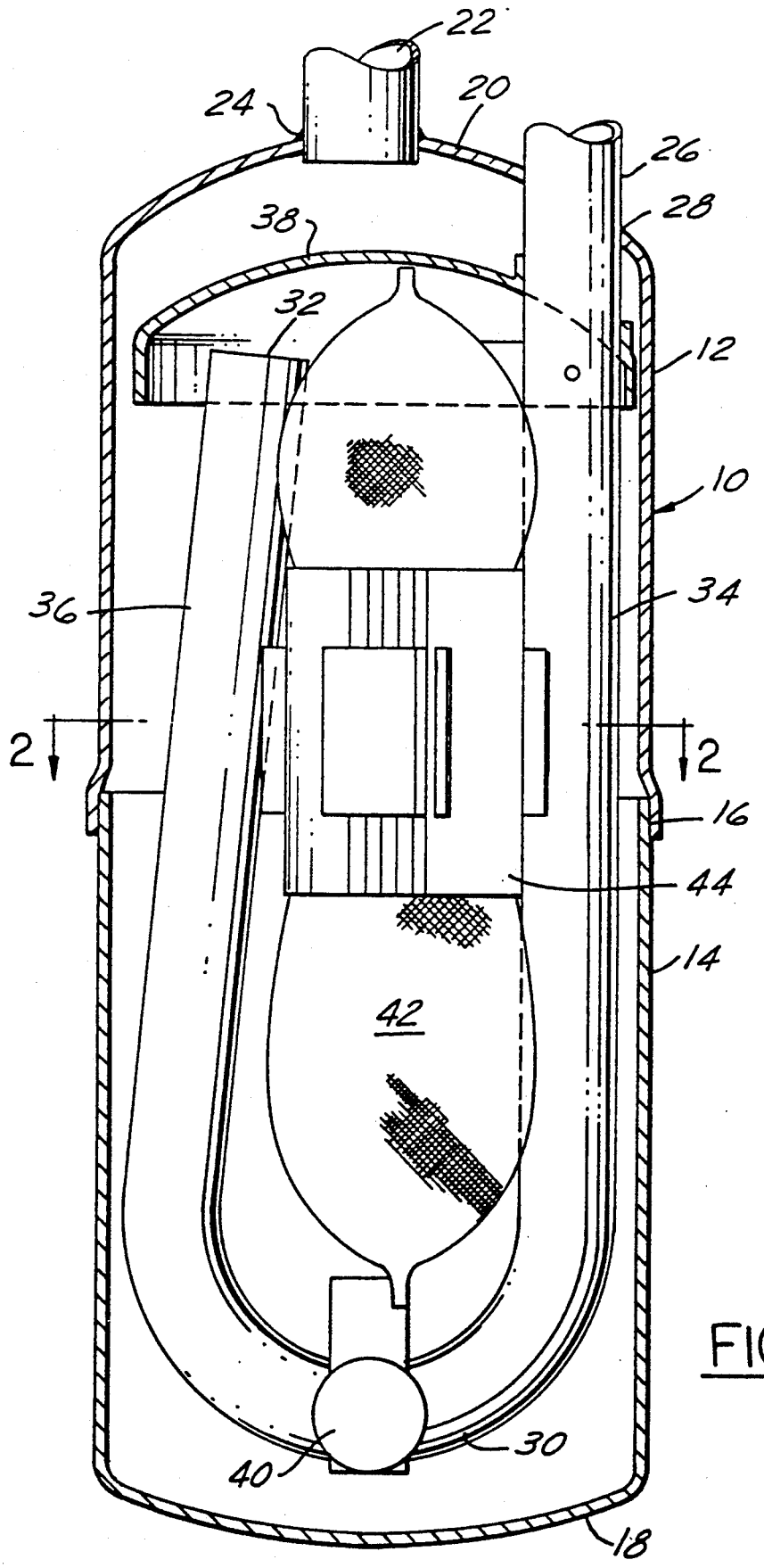
FIG. 1 is a cross-sectional view of an accumulator assembly showing the improvement of the present invention.
Figure 2:
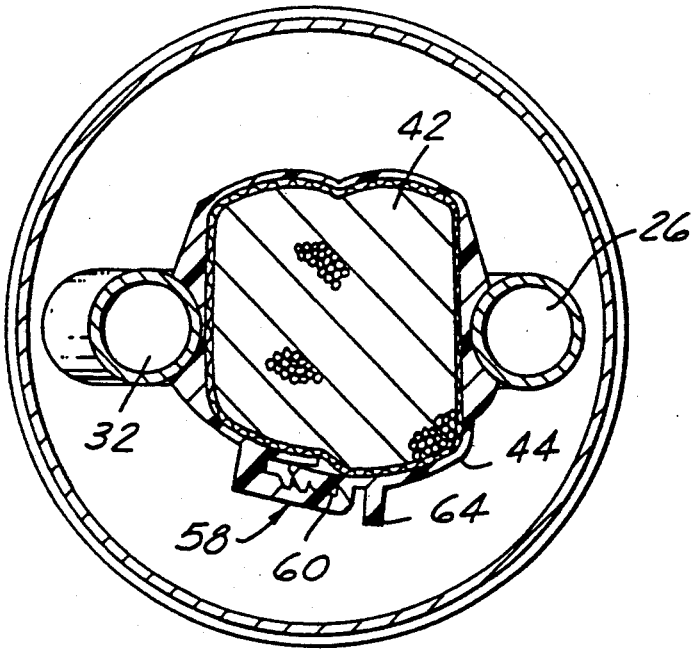
FIG. 2 is a cross-sectional view taken along line 2—2 of FIG. 1.

Referring now to the drawings, FIGS. 1 and 2 show an accumulator assembly for use in an automotive air conditioning system of the type known in the art and such as disclosed in U.S. Pat. No. 4,474,035, the disclosure of which at column 2, lines 30-column 4, line 10 is hereby incorporated by reference. As is well understood to one of ordinary skill in the art, but not shown in the drawings, the air conditioning system includes a compressor, the output of which flows to a condenser through a liquid line with an orifice tube (such as in a known, clutch cycling orifice tube configuration), then to an evaporator and then to the accumulator of the present invention and finally back to the compressor. As is shown in FIGS. 1 and 2, the accumulator includes a cylindrical housing 10 comprising an upper portion 12 and a lower portion 14. The portions 12 and 14 are joined together in abutting relationship at a predefined seam location 16 by means of an overlapping brazed or welded juncture. The lower end of the accumulator is closed by a lower wall 18, and the upper end of the accumulator is closed by a domed upper wall. An inlet tube 22 is received within an opening formed in the center of the domed wall 20 and is brazed at 24. An outlet tube 26 extends through another opening in the domed wall 20 adjacent to inlet tube 22, and it too is brazed to provide a pressure seal and a permanent juncture with the wall 20 as shown at 28.

Outlet tube 26 extends vertically adjacent the inner wall of the accumulator and is curved at its lowermost portion 30, the curved portion being situated in the lowermost region in the accumulator adjacent to lower wall 18. The tube includes a first pipe portion 34 at a second pipe portion 36 interconnected by the curved portion 30 and extends upwardly from the curved portion 30 to its inlet point 32. The inlet of the tube at point 32 is located within the interior of a domed baffle 38 such as shown in U.S. Pat. No. 4,474,035. The construction and configuration of the baffle 38 is well known to those skilled in the art, therefore, no further description thereof is deemed necessary. See U.S. Pat. No. 4,474,035, at column 2 lines 54–68 for a complete description of an exemplary baffle.

At the base of the accumulator portion 14 there is located an oil return orifice and filter assembly 44, structured as is commonly known in the art. The assembly comprises a plastic housing which is apertured and which includes a screen within the plastic housing. One end of the housing is curved so that it surrounds outlet tube 26. The portion of the housing that surrounds the outlet tube is split and the ends are fastened together by a fastener to facilitate quick assembly. As will readily be apparent to one of ordinary skill in the art, any known oil return orifice and filter assembly may be used with the present invention, and the present invention not being meant to be limited to the assembly described herein.

As further shown in FIG. 1, the accumulator of the present invention includes an adsorbent device, such as a flexible bag of desiccant 42 interposed between the first pipe portion 34 and the second pipe portion 36 of the outlet pipe 26. As will be explained in greater detail below, the desiccant bag 42 is retained in its proper location by a retaining clip 44. The flexible desiccant bag 42 may be fabricated from any of a number of known materials. The adsorbent or desiccant in the bag may be any of a known type of adsorbent, such as a silicate gel, metal alumino silicate, alumina, calcium sulfate, activated charcoal, or any other desired compound in bead, pellet or granular form depending upon the circumstance of its use.

Figure 3:
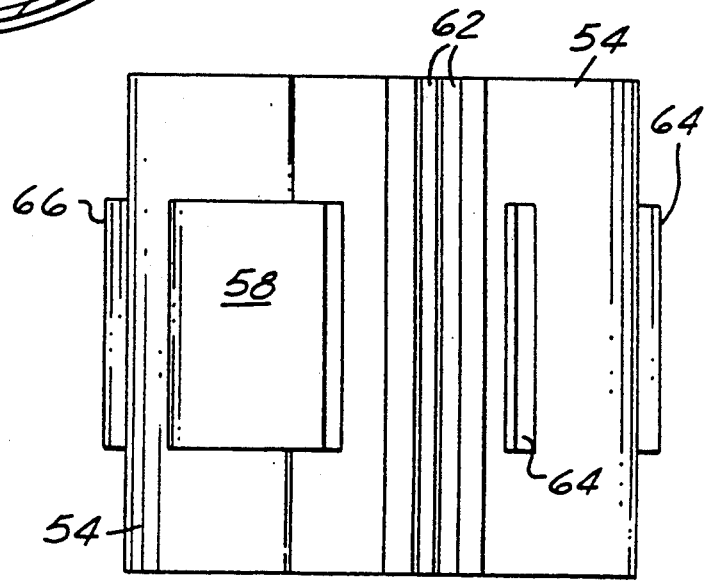
FIG. 3 is an elevational view of the retaining clip of the present invention.

As shown in FIGS. 1 and 2, the retaining clip surrounds the flexible bag of material and secures the bag 42 between the first and second pipe portions, 34, 36 respectively. The retaining clip 44 of the present invention is shown in further detail in FIGS. 3 and 4. The retaining clip 44 comprises a jaw like member including a first sidewall 46 and a second sidewall 48. Each of the first and second sidewalls, 46, 48, respectively, comprise a generally arcuate member having a generally planar base portion 50 and a pair of walls 52, 54 extending generally perpendicularly from the base portions 50. The first and second sidewalls 46, 48, are hingedly connected at 56 for relative open and close movement therebetween. The hinge 56 is a living hinge and comprises hinge means for connecting the first and second sidewalls 46, 48.

Figure 4:
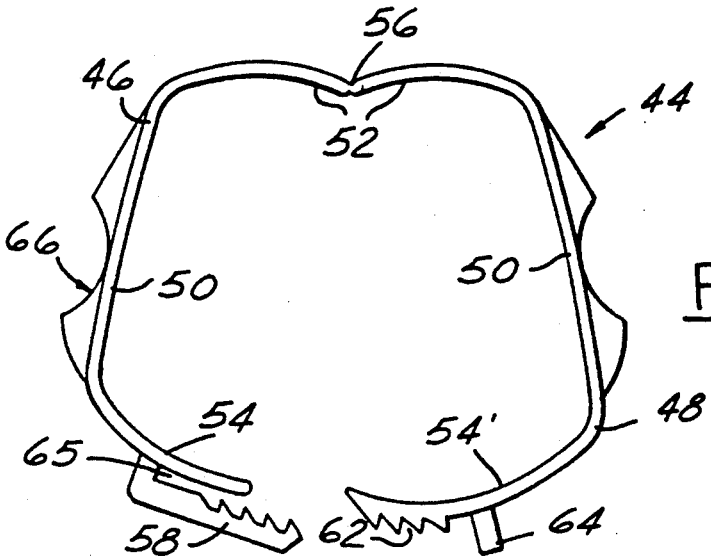
FIG. 4 is a top plan view of the retaining clip of FIG. 3.

On the opposite side to the hinge 56 of clip 44, the retaining clip 44 includes locking means such as shown by tab 58. Tab 58 is disposed on one of the walls 54 extending from the base portion 50. The tab includes a plurality of indentations 60 configured to matingly engage a plurality of ribs 62 formed on a wall 54' of the second sidewall 48. A detent mechanism 64 may be formed on the wall 54' to assure proper positioning of the tab with respect to the ribs 62. As shown in FIG. 4, the tab 58 and rib 62 are meant to be securely interlocked, but alternatively, may be fabricated so as to releaseably engage each other to provide for quick and easy replacement of the clip 44 from the bag 42. As can also be seen in FIG. 4, the rib portion 62 of sidewall portion 54 is meant to be interposed between tab 58 and the end of wall 54 in the space designated as 65. This can clearly be seen in the view of FIG. 2.

Referring back to FIGS. 3 and 4, the retaining clip 44 further includes a pair of arcuate-shaped grooves 66 formed integrally with each planar portion 50 of the first and second sidewalls 46, 48, respectively. The grooves 66 have a diameter slightly less than the diameters of the first and second pipe portions, 34, 36 of outlet tube 26 to matingly engage therewith. As such, the arcuate grooves 66 form tube engaging means for mating engagement with the first and second pipe portions, 34, 36 of the outlet tube 26.

The diameter of the retaining clip 44 is slightly less than the diameter of the flexible bag of desiccant material as shown in FIG. 1. This results in the retaining clip 44 forming the desiccant bag 42 in an hour glass configuration when secured around the bag 42. By doing so, the retaining clip 44 protects the bag from excessive heat given off during joining of the upper portion 12 to the lower portion 14 of the housing 10. The retaining clip 44 is placed such that it is proximate the weld seam location 16 to provide further heat protection for the bag during the welding process. As such, it should be readily apparent to those skilled in the art that the retainer clip is fabricated from a heat resistant material, such as glass filled nylons, polyesters, polypropylene, ABS, or other known synthetic polymeric materials.

It should be apparent that many variations and modifications of the present invention are possible without departing from the spirit and scope of the present invention. For example, the retaining clip 44 may be generally rectangular or generally cylindrical or configured in any of a number of known shapes. The retaining clip is fabricated in an injection molding fabrication process and other known fabrication processes may be utilized as well. The clip 44 may range in length from approximately 1–3 inches, the preferred size being approximately two inches and may be utilized in any type of automotive air conditioning accumulator. These and other modifications will, no doubt, occur to those skilled in the art. It is the following claims, including all equivalents which define the scope of my invention.

What is claimed is:

1. An accumulator for use in an air conditioning system for an automotive vehicle, comprising:

a housing having two portions joined together in abutting relationship at a predefined seam location to define a closed chamber, said housing having an upper housing wall and a lower housing wall;

an inlet tube extending through said upper wall of said housing;

an outlet tube extending through said upper wall of said housing and extending through said housing substantially the entire length thereof, said outlet tube having first and second pipe portions connected by a curved portion disposed at a lower extremity of said housing, said second pipe portion extending upwardly through said housing to a point proximate said upper wall of said housing;

retaining means surrounding an adsorbent device for securing said adsorbent device between said first and second pipe portions of said outlet tube, said means comprising a jaw-like member including a first sidewall and a second sidewall, each of said first and second sidewalls comprising a generally arcuate member having a generally planar base portion and a pair of walls extending generally perpendicularly therefrom, said first and second sidewalls being hingedly connected at one end thereof for relative movement therebetween and connectable at an opposite end thereto.

2. An accumulator according to claim 1, wherein each one of said pair of sidewalls includes tube engaging means formed integrally therewith for mating engagement with said first and second pipe portions.

3. An accumulator according to claim 2, wherein said tube engaging means is formed on said generally planar base portions of each of said first and second sidewalls.

4. An accumulator according to claim 3, wherein said tube engaging means comprises an arcuate shaped groove molded in each of said first and second sidewalls, the diameter of said groove being slightly smaller than the diameter of said first and second pipe portions for mating engagement therewith.

5. An accumulator according to claim 1, wherein said jaw-like member is generally rectangular.

6. An accumulator according to claim 1, wherein said jaw-like member is generally cylindrical.

7. An accumulator according to claim 1, wherein said first sidewall includes a tab disposed on a vertical wall thereof, said tab including a plurality of indentations adapted to engage a plurality of ribs disposed on a facing wall of said second sidewall.

8. An accumulator according to claim 7, wherein said tab is releaseably engageable with said plurality of ribs.

9. An accumulator according to claim 1, wherein said adsorbent device comprises a flexible bag of dessicant.

10. An accumulator according to claim 1, wherein said retaining means is interposed between said first and second pipe portions proximate said predefined seam location.

11. An accumulator according to claim 1, wherein said retaining means includes a diameter smaller than the diameter of said adsorbent device so as to form said adsorbent device into an hourglass configuration.

12. An accumulator for use in an air conditioning system for an automotive vehicle, comprising:

a cylindrical housing having two cylindrical portions joined together in abutting relationship at a predefined seam location to define a closed chamber, said housing having an upper housing wall and a lower housing wall;

an inlet tube extending through said upper wall of said housing;

an outlet tube extending through said upper wall of said housing and extending through said housing substantially the entire length thereof, said outlet tube having first and second pipe portions connected by a curved portion disposed at a lower extremity of said housing, said second pipe portion extending upwardly through said housing to a point proximate said upper wall of said housing;

retaining means surrounding a flexible bag of dessicant material for securing said bag between said first and second pipe portions of said outlet tube proximate said predefined seam location, said means comprising a generally rectangular jaw-like member including:

a first sidewall hingedly connected to a second sidewall, each of said first and second sidewalls comprising a generally U-shaped member having a generally planar base portion and a pair of walls extending generally perpendicularly therefrom, said first sidewall including a tab disposed on one of said walls and including a plurality of indentations for mating engagement with a plurality of ribs disposed on a wall of said second sidewall; and an arcuate shaped groove molded in each of said first and second sidewalls, the diameter of said groove being slightly smaller than the diameter of said first and second pipe portions for mating engagement therewith.

13. An apparatus for retaining an adsorbent device between a pair of tubular members in an accumulator of an automotive air conditioning system, comprising:

a pair of generally planar, opposite facing sidewalls, each sidewall having a tube engaging means formed integrally therewith for mating engagement with said tubular members;

a third side interconnecting one end of said pair of sidewalls and including hinge means for relative open and close movement of said pair of sidewalls; and a fourth side interconnecting an opposite end of said pair of sidewalls and including locking means for securing said retaining means around said adsorbent device.

14. An apparatus according to claim 13, wherein said tube engaging means comprises an arcuate shaped groove molded in each of said pair of sidewalls, the diameter of said groove being slightly smaller than the diameter of said tubular members for mating engagement therewith.

15. An apparatus according to claim 13, wherein said locking means comprises a tab formed on said fourth side, said tab having a plurality of indentations adapted to matingly engage a plurality of ribs formed proximate thereto.

16. An apparatus according to claim 13, wherein said hinge means comprises a living hinge.

17. An apparatus according to claim 13, wherein said apparatus is generally rectangular.

18. An apparatus according to claim 17, wherein said apparatus includes a diameter smaller than the diameter of said adsorbent device so as to form said adsorbent device into an hourglass configuration.

19. An apparatus according to claim 13, wherein said apparatus is fabricated from a material selected from the group consisting essentially of nylons, ABS and polypropylene.

* * * * *